United States Patent [19]

Herzig

[11] Patent Number: 5,072,855

[45] Date of Patent: Dec. 17, 1991

[54] CURVED SEMI-RIGID PLASTIC RIB CLOSURES FOR FLEXIBLE CONTAINERS

[76] Inventor: Albert M. Herzig, 700 N. Rexford Dr., Beverly Hills, Calif. 90210

[21] Appl. No.: 483,249

[22] Filed: Feb. 22, 1990

[51] Int. Cl.[5] ..... B67D 5/32

[52] U.S. Cl. ..... 222/39; 222/212; 222/484; 222/494

[58] Field of Search ..... 222/212, 214, 494, 498, 222/39, 481.5, 484

[56] References Cited

U.S. PATENT DOCUMENTS

| | | | |
|---|---|---|---|
| 2,181,430 | 11/1939 | Hudson | 222/497 |
| 2,947,448 | 8/1960 | Maddux | 222/494 X |
| 3,486,666 | 12/1969 | Herzig | 222/494 |
| 3,635,376 | 1/1972 | Hellstrom | 222/498 X |
| 4,124,150 | 11/1978 | Moss | 222/494 |
| 4,592,493 | 6/1986 | Smith | 222/498 X |
| 4,836,415 | 6/1989 | Grussmark | 222/39 |
| 4,928,852 | 5/1990 | Guiffray | 222/498 X |

*Primary Examiner*—Michael S. Huppert
*Assistant Examiner*—Gregory L. Huson
*Attorney, Agent, or Firm*—Albert M. Herzig

[57] ABSTRACT

A self-closing squeeze container. A resilient curved plastic rib of a degree of flexibility which is used to tighten the mouth of the container with a suitable resilient return force of the rib. The rib is fastened to the ends of the mouth to keep the mouth closed under its own tension which can be overcome when the container is squeezed by hand strongly enough to flex the rib but not enough to stretch the mouth. This is done by using the force needed to retain the rib's resistance to being straightened out. Examples are given in collapsible and stand-up flexible containers including flip-top types, smooth-opening types, and audible, including audible-"snap"-action, varieties using the idea.

10 Claims, 3 Drawing Sheets

FIG. 6.
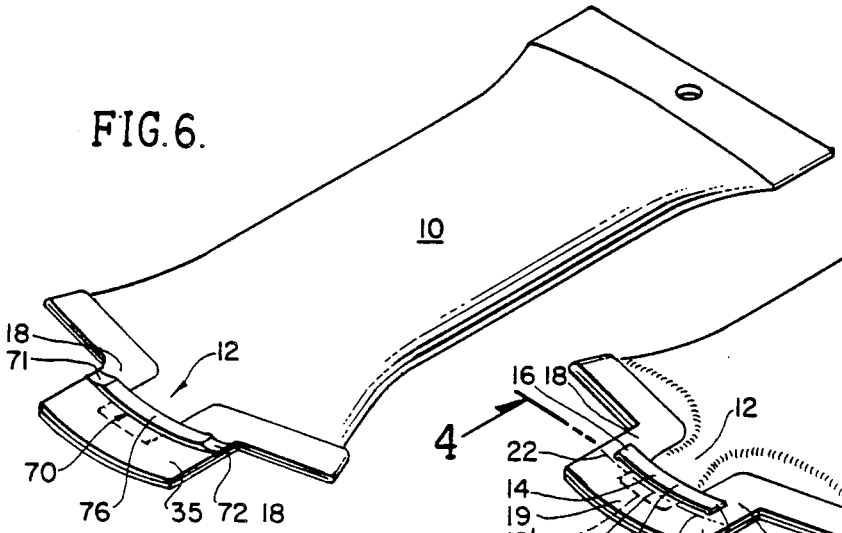
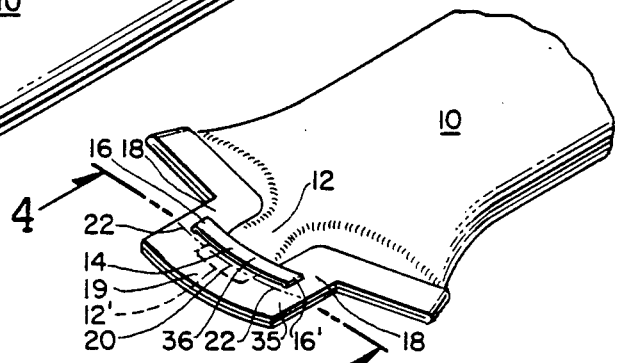
FIG. 1.
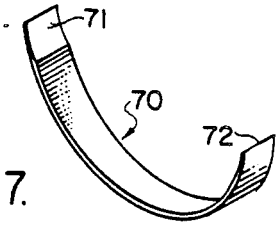
FIG. 7.
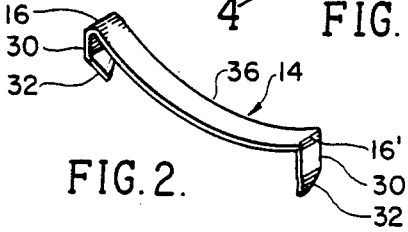
FIG. 2.
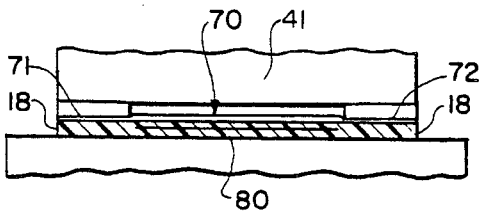
FIG. 8.
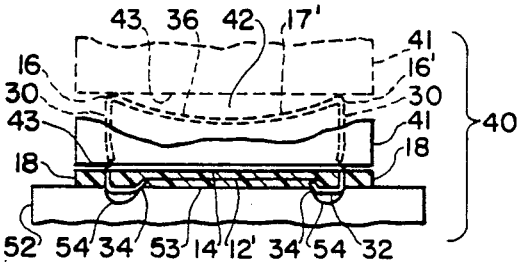
FIG. 3.
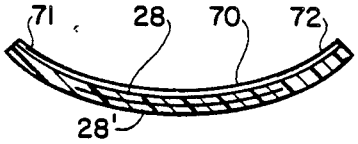
FIG. 9.
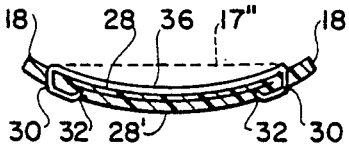
FIG. 4.
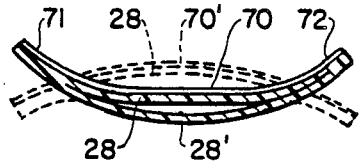
FIG. 10.
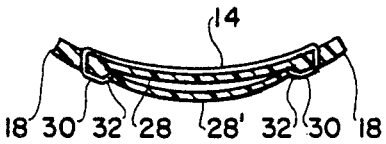
FIG. 5.

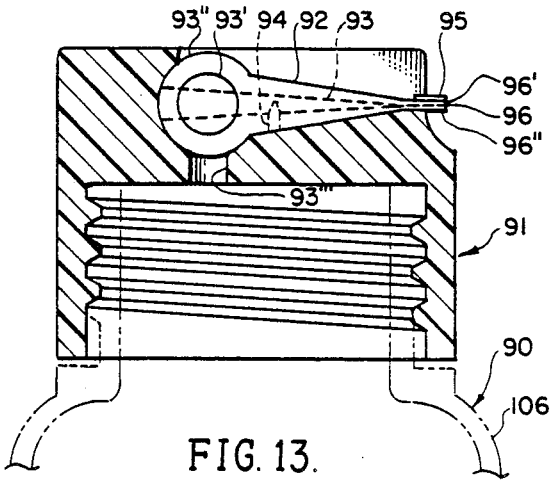
FIG. 13.
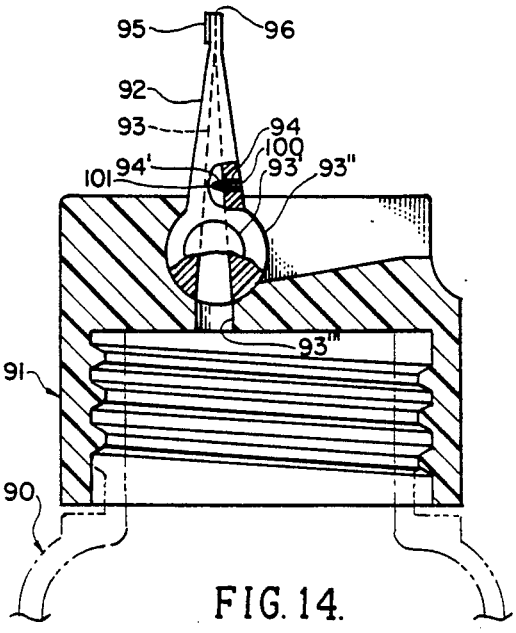
FIG. 14.
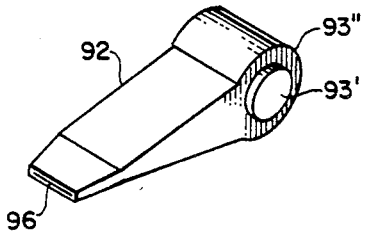
FIG. 15.
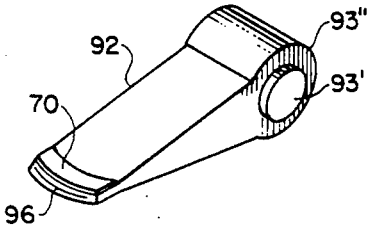
FIG. 16.
FIG. 17.
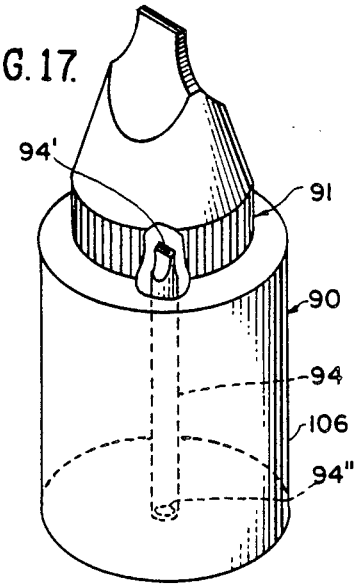

CURVED SEMI-RIGID PLASTIC RIB CLOSURE FOR FLEXIBLE CONTAINERS

BACKGROUND OF THE INVENTION

1. Field of the Invention

Flexible container closures have been constructed and applied in a manner requiring relatively complex, costly, and slow apparatus and procedures. It is desirable that the closure means and method facilitate application of a staple-like rib or closure member formed and applied in a manner to shorten the crown distance between the staple ends which stretches the container mouth and facilitates its normal closing by an initial bending of the staple in an improved design and method embodying improved simplicity and economy of structure and method.

2. Description of the Prior Art

Prior Art U.S. Pat. Nos. 2,753,091; 2,815,150; 3,451,120; 3,469,478; 3,486,666; 3,469,478; and 3,610,477 (the latter issued to applicant, et al.), represent the most relevant prior art known to applicant.

The above prior art—considered singly or together—does not anticipate and does not suggest as obvious, the particular structure of the herein claimed closure means and method, and applicant has no knowledge of any prior art disclosing such particular simplified structures or methods of assembly thereof.

SUMMARY OF THE INVENTION

The present invention has as a major object an improved closure for a collapsible, flexible container, and/or positioning, preferably on one side of the container neck, a simplified end construction adapted for securement on the container neck in an improved manner to stress and apply predetermined closing pressure thereto wherein, upon application of an opening squeeze, pressure causes any viscous contents of the container to flow between the lips, and wherein upon release of such pressure the lips automatically re-close. The ends of a rib or staple-like reinforcing, stressing and/or stretching member are adapted for facile application to the container mouth adjacent to its open end by a essentially simplified and direct hammer-and-anvil type of securement as by a preferably simultaneous stapling and bowing operation.

The mouth reinforcing means in its first preferred embodiment is a staple-like means with a downwardly bowed springy crown formed at its opposite ends with legs adapted to be secured across the mouth of the tube, and secured as at opposed shoulders at each side of the mouth in an initial flattened condition pressed between preferably straight parallel dies to clinch the staple across the mouth and secure it at both sides so that upon release of the dies, the resilient crown of the staple will resume its downward curve, thereby placing the mouth of the tube in a stretched and biased condition of optional advantageously curved configuration. The staple legs are configured to penetrate or clinch in a manner to accommodate the difference between the length of the crown when it is in its usual curved condition or in a relatively flattened or reverse-curve shape while being secured across the neck.

In a second preferred embodiment, a springy type of flexible inherently curved plastic rib of relatively more rigid material than the material of which the container is made, is secured at its ends to the sides of the mouth of the container, preferably by fusing with heat. The curved rib is applied under pressure tending to straighten it while its ends are secured as aforesaid (or as by sealing, riveting, stapling, or cementing). The release of pressure permits the rib to return to its inherently curved shape. Because of its said inherent springy resilience, the rib thereby applied closing force to the mouth of the container.

A third embodiment comprises a closing rib having a curvature and configuration adapted to yield to the fluid pressures exerted against the rib for opening the mouth in a manner to cause a sudden "clicking" accompanying reversal of the curvature and shape of the rib. The rib is thin and flexible, and the involved container wall is shaped, arranged, and constructed so that upon squeezing the container, the opening force act to press the rib into an over-center shape-reversal generally accompanied by said clicking sound. The mouth thereupon is temporarily relieved and suddenly clicks into a fully open position.

A fourth preferred embodiment is applied to a flip-top container. The mouth is held in a releaseably closed position in a manner as aforesaid and remains releaseably closed except when the container is squeezed. The container is normally sealed when the flip-top is in its closed position, and can be so manually sealed despite the application of normally opening pressure.

A fifth embodiment is designed for application of a curved, springy reinforcing mouth closing means by a single-action application of a rib across the mouth, reverse-curving the rib in so doing and, as the ends are secured at the edges of the mouth on each side, releasing the rib to place the mouth under stress and closing pressure.

The present invention provides as a further object improved means and methods for accomplishing the intended result through more facile, effective, and economic manufacture.

The invention provides as a further object an improved economic resilient closure and method of making the same which is simple and effective for the purpose for which it is designed.

BRIEF DESCRIPTION OF THE DRAWINGS

Having thus described the invention in general terms, reference will now be made to the accompanying drawings in which:

FIG. 1 is a perspective view of a squeezable container of the collapsible type illustrating mouth reinforcing and shaping means embodying the invention in a first embodiment.

FIG. 2 is a staple embodying the inventive concept in perspective view.

FIG. 3 is a vertical cross-sectional elevational view illustrating improved means and method for providing the closing means to the mouth of the container.

FIG. 4 is cross-sectional view taken along the line 4—4 of FIG. 1 showing the staple applied and the mouth in closed position.

FIG. 5 is a view similar to FIG. 4 but showing the mouth in pressurized open position for extruding the contents of the container therethrough.

FIG. 6 is a perspective view of a collapsible type of squeezable container in a second embodiment.

FIG. 7 is a perspective view of the closure rib of FIG. 6 before securing to the container.

FIG. 8 is a vertical view of a die means and method of applying the rib of FIG. 7.

FIG. 9 is an end view after applying the rib of FIGS. 6 to 8.

FIG. 10 is a view like FIG. 9 illustrating the optional "clicked"-open condition of the mouth of said container.

Figure 11:
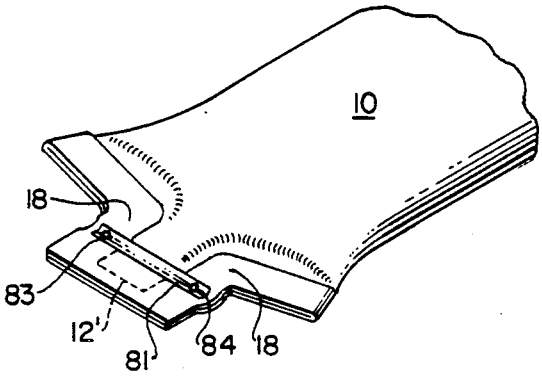

FIG. 11 is a perspective partial view of another "clicker"-type of container closure construction.

Figure 12:
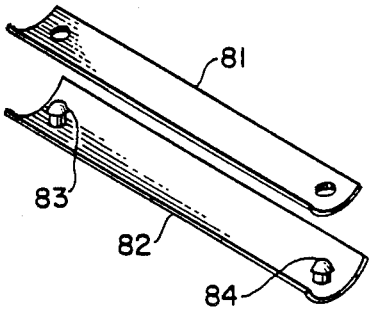

FIG. 12 is a perspective view of the snap-acting ribs.

Figure 12A:
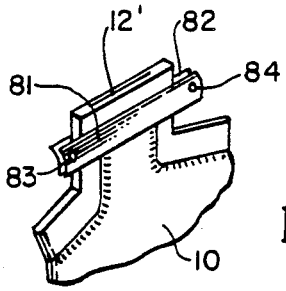

FIG. 12A is the front perspective view of said other "clicker" form.

Figure 12B:
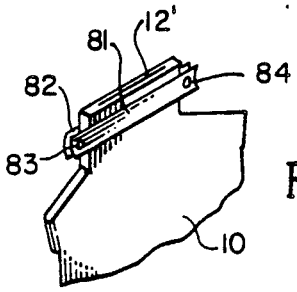

FIG. 12B is the back perspective view of the "clicker" form of FIG. 12A.

FIG. 13 is a flip-top container construction (in closed position) embodying this invention.

FIG. 14 is a flip-top container construction (in openable position) embodying this invention.

FIG. 15 is a first optional resiliently openable closure for a flip-top container construction in other respects corresponding to FIGS. 13 and 14.

FIG. 16 is a second optional openable closure of a flip-top container construction corresponding to FIG. 13 and 14 in all other respects.

FIG. 17 is a squeezable bottle embodying this invention.

Figure 18:
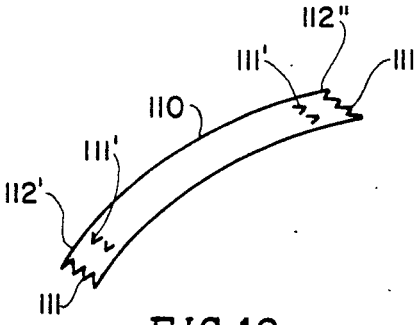

FIG. 18 is a perspective view of a stretch rib embodying features of this invention.

Figure 19:
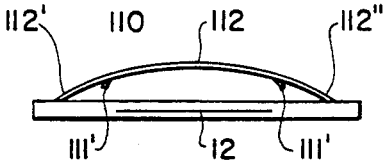

FIG. 19 is a frontal view of the stretch rib being applied.

Figure 20:
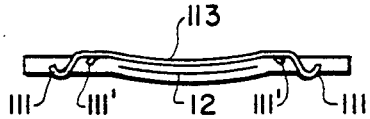

FIG. 20 is a frontal view of the stretch rib as applied and reverse-bowed.

Figure 21:
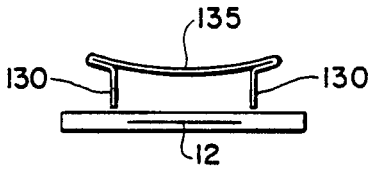

FIG. 21 is a perspective segmental view of another stretch rib and squeezable container mouth area embodying the idea.

Figure 22:
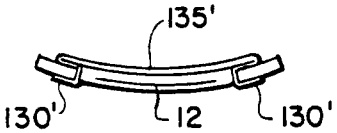

FIG. 22 is a similar view to FIG. 21 with the stretch rib applied to the said mouth area.

DETAILED DESCRIPTION OF FIRST PREFERRED EMBODIMENT

Referring now more particularly to the drawings and to the reference numerals and letters marked thereon, a first preferred embodiment of this invention is illustrated as incorporated in an collapsible flexible container or tube as shown at 10 in FIG. 1. The tube comprises a wall of resilient flexible barrier material made from a suitable, preferably stretchable and/or resilient plastic such as vinyl, polyethylene or other commercially available rubber-like material. The tube 10 optionally includes a neck portion at 12 with similar, if not the same, stretchable resilient and barrier qualities.

A staple 14 of stainless steel is secured at its ends 16, 16' to the outer edges 18 of the container mouth 12'. To dispense the fluid or viscous material sealed within the container, a portion 20 forward of the staple 14 is cut off as at line 22—22, thus removing the sealed forward edge 19 and exposing the mouth 12' of the neck 12 of the container, the contents of which are dispensed between the lips 28, 28'.

Referring now to FIG. 2 of the first preferred embodiment, the means for shaping the mouth 12' and holding it in tension and closed position comprises a staple 14 having vertical legs 30 prior to their being installed on the container mouth, and having formed therein preferably slightly in-turned ends 32, being hook-like 34 to facilitate the gripping action of the staple legs and concealing their otherwise obtrusive appearance. The preferably resilient crown 36 of the staple is concave in that it normally extends downwardly to press against and across the mouth of the tube to hold it yieldably closed. The ends of the staple legs are formed to facilitate penetration of the tube adjacent the mouth providing shoulder 18 for securement of the reinforcing means, such as the staple, and to form a closed mouth throughout its width and to provide closure thereof under the springy influence of the reinforcing staple means.

Installation of the staple 14 is accomplished by a stapling mechanism 40 which can be of a hammer-and-anvil type as shown in FIG. 3. The staple is fed into the throat 42 of the stapling mechanism 40 in the path of a hammer 41 having a flat lower surface at 43 which engages the preferably sharply curved portions 16, 16' of the crown of the staple to form the integral legs 30. An anvil 52 preferably essentially flat in its central portion 53 but having grooves 54, engages and turns the legs to clinch the staple to the side edges 18 (lands) of the container, said land edges at 18 defining the mouth and neck.

The force of the flat surface 43 of the hammer 41 is not only designed to force the staple legs through the fused land area laterally adjacent the mouth passage 12', and also to clinch the staple legs around said material by virtue of the shape of the staple legs at their ends and the clinching grooves 54 in the anvil 52. That force is also calculated to temporarily flatten the crown 36 between said flat surface 43 of the hammer and the mouth of the container which is compressed between said flat surface of the jammer and the upper flat surface 53 of the anvil parallel thereto.

Thus, being squeezed between the hammer and the anvil, the staple is compressed and its resilient crown is flattened as aforesaid until it assumes said flat position shown in dotted outline at 17'' in FIG. 4. However, upon release of pressure between the hammer and the anvil, the inherent resilience and curvature of the staple crown 36 restores the crown to its downwardly curved shape shown in FIG. 2, 3 (dotted), 4 and 5, placing the mouth and the lips 28 and 28' thereof (the upper and lower lips respectively) in tension against and around the greater curvature of the crown as opposed to the shorter straight line length of the crown 17'' (dotted in FIG. 4).

The mouth is, by such means, automatically and effectively closed. It is effectively opened, as illustrated in FIG. 5, for releasing its contents under manual squeezing pressure on the container. Such action is dependent on the nature, elasticity and memory of the material of which the container and its neck is made, and also on the relative degree of springiness or rigidity of the crown 17, the deflection and tensioning pull of the curved staple on the mouth, and the radius of curvature of the staple crown.

The desired result is accomplished, however, by a simple stapling action wherein the crown is preferably momentarily flattened during its application.

Upon release of squeezing pressure, the closing forces of the normally curved crown (dotted lines at 17', FIG. 3) cause the mouth to reassume its closed shape as illustrated in the solid lines in cross-section in FIG. 4.

Normally, the lower lip 28', as illustrated in FIG. 4 and 5, is free to move into a mouth-open position and its elasticity contributes to the opening and closing action. The other parts, including the staple crown and the lower lip 28' affect the mouth's moves to opening or closing position. Their strength and relative rigidity can be designed to participate more or less, as desired, in the opening and closing action.

DETAILED DESCRIPTION OF SECOND PREFERRED EMBODIMENT

Referring now to the illustrations in FIGS. 6 through 10, the container 10 and parts otherwise optionally the same as in the first embodiment, are designated by like reference numerals.

In the second preferred embodiment, however, a resilient rib preferably of springy plastic having an inherent resilient curvature as illustrated most clearly in FIG. 7, has been employed to advantage. For example, such a rib made of vinyl more rigid than the body of a compatible vinyl tube with which it is associated, has proven to have particularly smooth, effective and superior mouth opening and closing properties.

As in the preceding first preferred embodiment, the rib 70 with its inherent flexibility and resilience, may be laid over the mouth of the container as illustrated in FIG. 8, and secured at its opposite ends 71 and 72 as by heat-sealing, cementing, riveting, stapling, or the like, preferably heat-sealing as by sealing dies 71', 72'.

To accomplish the purpose, sealing dies 71', 72' are employed having a flat central portion 70' composed of dielectric material so as to avoid sealing the mouth portion of the tube spanning that area. The normally curved rib 70 is pressed over the tube mouth portion, as shown in FIG. 8, and against the optionally flat anvil surface 80 as there illustrated, with sufficient force to cause the resilient rib 70 to lie flush over and across the neck of the tube—optionally from side to side thereof including all or a portion of the land 18 defining the side edges of the mouth of the tube including the shoulder area 35 and in particular the portion surrounding, forming, and defining the neck 12. In that relatively flattened position the die electrodes can fuse the advantageously thinned ends 71 and 72 of the rib of the tube to said sides of the neck without intruding on the neck. Their desired central flush confronting faces bear against and form the lips 28 and 28'. After sealing or securement in their flattened position, the resilient springy ribs, in similar fashion to the crown 36 of the first preferred embodiment, reassume their preferred curved position, thereby stressing and stretching the mouth area and forming the closure which is likewise openable upon the application of sufficient pre-determined pressure for squeezing out the contents between the thus closed and tensioned lips with or without perceptible stretching of the lips 28 and 28' as best illustrated in FIG. 10 where the upper lip 28 there illustrated in solid outline has begun to flex against the rib 70 starting the reverse curve of said rib as there illustrated. Meanwhile, as there also illustrated, the lower lip 28' therein, while retaining its closed shape (illustrated in FIG. 9) and resisting stretching of the lip thereby, forces the upper lip 28 with greater force against said upper lip and its adjacent rib 70 to next snap reversely as illustrated in dotted lines which define the reverse curve herein-referred to as therein illustrated. Such reverse curve forms when continued pressure is applied to the tube resulting in said reverse curve by snap action sometimes accompanied by a snapping sound when the reverse curve action is completed as in FIG. 10 illustrated in said dotted lines.

The plastic rib provides not only a more attractive, versatile and appealing appearance, but also an improved smoothness and facility of flow when the desired squeezing pressure is applied than. Thus, a flexible vinyl plastic tube 0.0010" thick having applied thereto a more rigid vinyl rib of approximately 0.0015" thick, provides an optimum closure and a smooth open flow under squeezing pressure, with an excellent degree of closing pressure for the mouth, and a desired facility of use in squeezing out the contents when used.

A "clicker"-like modification of said rib 70 is illustrated in FIGS. 11, 12, 12A, and 12B. Therein, upon application of squeeze-opening pressure on the container 10, a wall 10*a* thereof is forced to bulge. Said bulge is transmitted to the mouth area where the opening of the mouth is occasioned by flexing and/or stretching of the lip which is contiguous with the thin arcuate rib 81 which is flexible, springy, and thin—as illustrated in FIGS. 11 and 12B. When the rib 81 is thus upwardly bowed with and/or without stretching of the mouth as illustrated in FIG. 10 at 70' where, it reaches a point of initial bending, depending upon the pressure needed to overcome the springy flexibility of the clicker rib 81, preferably disk shaped at 81', to receive and be impressed with a sudden reverse curvature or bow as illustrated in dotted outline in FIG. 11 (also as in FIG. 10 of the second embodiment). In FIG. 7, for example, said bowing-in-reverse of the rib across the neck of the tube as illustrated in said dotted outline at 70' can carry with it all or a significant portion of the laterally outwardly adjacent walls and the mouth of the container, depending on their configuration and relative degree of stretchability and/or flexibility. With a proper curvature and/or by a suitable dimple shape on the rib 70 (FIG. 10) or 81 (FIG. 11), it can be caused to induce an audible sudden "click" sound in performing said shape-reversal when applying sufficient opening squeeze-pressure on the tube or container. The contents will thereupon readily flow as the closing pressure against the mouth is relaxed. Closure is restored when squeeze pressure is topped and the rib snaps back to close the stretched and/or mouth.

A similar clicking type of closing and/or opening action is obtained by use of spring-like material by such elongate rib of curved transverse cross-section like the blade of a coiled concave-convex steel spring measuring tape, of a shape illustrated in FIGS. 11, 12A and 12B. Such a curved coiled blade form can be made with a single blade or rib as in FIG. 10 or a double blade 81 and 81 (FIGS. 11–12B). The double blades 81 and 82 can be attached to each other at their ends as by rivet snap fasteners 83 and 84 or the like securement, removedly connecting them by snap fasteners at said ends, or permanently. If permanent, the rivets can include and find securement in the edges (lands) 18 around the mouth of the container 10.

The blades 81 and 82 are preferably nested as shown. Both can give (snap apart) or merely one blade (the inner one 81) can be configured and sized to snap and/or yield to provide and permit flow through the container neck and mouth 12'. The relative stiffness of the blades and/or their width or thickness can be structured and configured to adjust the ease of flow from a squeezed container, or its greater or lesser resistance to flow therefrom. The radius of the curvature of the blades is similarly restrictive or facilitative of flow of a fluid stored in a container.

DETAILED DESCRIPTION OF THIRD PREFERRED EMBODIMENT

FIGS. 13, 14, 15, and 16 illustrate the use and adaptation of the foregoing ideas to a flip-top closure, usually employed in squeezable stand-up plastic containers.

For example, a container 90 of the type referred to is fitted with a cop 91 having a flip-flop neck 92 with a bore or tapered inside passage 93 therein. In the open position as shown in FIG. 14, material may be squeezed from the container 90 usually by inverting the container. The segments of the bore 93 in the neck 92, including parts 93' in the hub portion 93'' of the container, pass through the lower portion 93''' of the neck.

The neck 92 has a cut-out portion 94 in which a one-way (check) valve 94' is inoperatively accommodated in the closed position of the flip-flop as illustrated in FIG. 13. The one-way valve is operative in the open position (FIG. 14).

It is customary in containers of this nature that the bore 93 extend continuously through the flip-top and from the interior of the container 90, with or without significantly altering the shape or diameter of the bore 93 in the open position. Thus, when the container is inverted and squeezed the contents flow out through the bore 93 rather freely and when the container is restored to its upright position, the container walls reassert themselves from their squeezed and partially collapsed condition; and, in so doing, air is drawn back from the atmosphere through the bore 93 into the interior of the container restoring the desired roundness or other original shape to the container. If that were not so, the container would remain partially collapsed and unsightly. However, if a prior art container is left in its open position as shown in FIG. 14, the outer end of mouth of the bore remains fully open and unsanitary, and the entire contents are exposed to contamination. This is an undesired result which persists whether the flip-top is in the open or closed position, because the mouth is not held closed. Thus, in the vertical (open) position (FIG. 14), the entire contents of the container itself is totally exposed to the atmosphere.

But, by the use of the instant invention, flip-flop mouth 96 is normally closed by the disclosed means to accomplish the stated purposes. For example, in FIG. 15 and 16 a desired breadth of the flip-flop mouth permits a ribbon of viscous material or liquid to be extruded or squirted from the container in the open position thereof (FIG. 14) and yet permits sealing of the container in the closed position (FIG. 13) not only within the bottle or container, but also at the outermost end 96 which defines said mouth formed with closing lips 96' and 96''. Said lips can be thin and flexible enough to be yieldingly closed as by a reinforcing member 70 (FIG. 16) corresponding to the plastic member 70 or staple 14, for example, in the prior embodiments applied thereto and operable in a similar manner. Said openable closure operates similarly under squeezing pressure applied to the container. The mouth, if of a more rigid plastic, may be made curved (FIG. 16) [as in Applicant's Patent No. 4,252,257, FIG. 5 thereof] or straight (FIG. 15) [as in Applicant's prior art Patent Nos. 3,825,157 and 3,610,477] to obtain the slit shape at 96 as desired.

After squeezing the container 90, the walls of which are normally resilient, means must be provided to permit air to be drawn into the squeezed and partially collapsed container 90 by the re-expanding walls thereof. Such means in this embodiment includes said check valve 94' such as a "raspberry"-type tube 94 having resilient compressible and expandable side wall 99 and a passage 100 therethrough and terminating in a pinched end 101 extending through the neck at 94. The structure of the pinched end 101 is such as to permit air to enter the container 90 through the passage 94. It is thereby serves as a one-way or check-valve permitting the air to enter in the open flip-flop position shown in FIG. 14 and preventing its exit from the container or the passage 93 as when the container is inverted, also illustrated in FIG. 14. Therefore, when the container is squeezed in a preferable and customary inverted position, the fluid contents will be dispensed through the mouth 96, but will not flow out under said pressure through the check valve 94'. thus, also in the open position of the cap, fluid contents of the container 90 are extruded through the mouth 96 on the flip-flop member 92, but will not leave the container through the mouth 94' which acts similarly for such purpose as a check-valve permitting an inward but not an outward flow of air (or fluid) through said check valve-like mouth 96.

In the sealed position of the flip-flop as illustrated in FIG. 13, the generally circular valve body 93'' of the flip-flop closes the bore 93 of the flip-flop with respect to its axial passage 93'' and the check valve 98 as well. The container is thereby effectively sealed closed.

The container 90 nevertheless is not open to the atmosphere, but is as stated, closed at its mouth 96 against contamination.

The new and improved automatic closure means is thus usable for collapsible containers (FIG. 17) as well as for squeezable stand-up plastic bottles or the like, utilizing flip-flop valves and resilient side walls 106. Also, the closure means illustrated in FIG. 17 is usable when equipped with a check, e.g. "raspberry" valve 94' at the top of an air inlet tube 94 extending through the bottom 94'' or other wall of the container and preferably above the level of the contents.

DETAILED DESCRIPTION OF THE FOURTH PREFERRED EMBODIMENT

As illustrated in FIGS. 18, 19, and 20, a metal or stiff plastic or metal-like reinforcing rib 110 is preferably provided with any number of serrations or fingers 111 at both ends 112' and 112'' thereof. The rib 110 has an upward curvature in its crown portion 112 as shown in FIG. 19.

Upon bending and compressing the same between a hammer and anvil of a shape conforming to the top configuration 113 of FIG. 20, together with suitable stapling-type of grooves to turn the serrations or fingers 112 into their clinching shape as shown in FIG. 20, the fingers 111 will fix themselves in and stretch the mouth of the container while reinforcing and pressing against the mouth of the container. The solid final position of the simple staple of FIG. 19 thus assumes its opposite curvature as illustrated at 113 of FIG. 20, without the necessity of any additional procedural steps.

Points 111 formed in the body of the rib laterally of the mouth or neck further secure and fix the rib and secure it in place by extending into or through the land are and/or clinching them at their ends.

DETAILED DESCRIPTION OF FIFTH PREFERRED EMBODIMENT

In the fifth preferred embodiment, downwardly extending penetrating legs illustrated at 130 in FIG. 21 and 22 are positioned over the container mouth 12 and compressed between corresponding hammer and anvil structures, causing the legs 130 to penetrate and be secured on the opposite side of the mouth 12, as illustrated at 130 in FIG. 21. The crown 135 as in its final and secured position of FIG. 22, has impressed upon it thereby the reversed curve 135' in FIG. 22.

The mouth 12 of the container is thereby stretchable and/or compressible with the aid of and by and between closing forces applied thereto by the ends of the legs illustrated and described in FIG. 5.

The invention described above is susceptible to variations, modifications and changes within the skill of the art. It should be understood that such variations, modifications and changes are within the spirit and scope of the invention and the appended claims.

I claim:

1. A curved resilient rib means having end fastening means for securing it to the side edges of a flat mouth of a flexible container, said rib means being constructed and arranged with less resistance to reverse flexure than the resistance to stretching of the mouth of the container, whereby squeezing force applied to a container having fluid entrapped therein causes the mouth of the container to reverse the rib curvature for opening the container in a manner to carry with it the ends of the rib towards a reverse bending of the rib from a concave towards a convex shape, wherein the changed curvature of the rib means results in a sudden audible "click" action.

2. In combination with a flattened mouth of a flexible unstretchable thinwall container, said mouth having side edges, a resilient normally curved elongate plastic rib means, said rib means having end portions, (a) means for securing said rib means at said end portions to corresponding edges of said side edges of said mouth in a common relatively curved state of said rib means defining a convex and a concave side, said convex side bearing against said mouth;

(b) said rib means having a degree of inherent resilient restorative springy strength sufficient to return said rib means from a relatively flat state to said normally curved state for imposing said convex curve of said convex side against, across, and transversely of said mouth for holding said mouth in a resilient and curved closed condition;

said mouth being operably and primarily openable by squeezing pressure applied to said container for flexing said rib means said opening of said mouth detectible by an audible click produced by the flexing of said rib.

3. The combination of claim 2, wherein said rib means comprises resiliently flexible springy plastic between its said ends.

4. The combination of claim 2, said container having elastic memory.

5. The combination of claim 2, wherein said rib means is of a resiliently flexible metal between its said ends.

6. The combination of claim 2, where said securing means comprises leg means extending in the same direction as said convex side at each end of said rib means in the manner of a staple, said leg means being compressed, secured and clinched with force at each end at the respective side edges of said mouth while said convex side is flattened against the container mouth, thereafter releasing of said compressing force restores said mouth closing convexity of said rib means..

7. The combination of claim 2, wherein said rib means is a staple having a crown formed with a convexity on its underside and two legs extending downwardly corresponding to the direction of said convexity.

8. The combination of claim 2, including horizontally pivotal flip-top valve means for manually selectively sealing or unsealing of the container as desired for usability or storage, said container incorporating resilient side walls and bypass check valve means therein for permitting a return of air into an upright partially collapsed container by the reexpanding walls of the container following the extrusion of contents and for bypassing the container's yieldably closed mouth means after squeezing out some of its contents.

9. The combination of claim 2, said degree of inherent resilient restorative springy strength is of the magnitude sufficient to return said rib means to a curved inherent initial shape from a flat state.

10. The combination of claim 9, wherein said flexible container is approximately 0.0010" and said semi-rigid rib is 0.0015" thick.

* * * * *